United States Patent [19]

Gobets et al.

[11] Patent Number: 4,718,860

[45] Date of Patent: Jan. 12, 1988

[54] TAPERED STRAIN RELIEF ELECTRICAL INTERCONNECTION SYSTEM

[75] Inventors: Roy A. Gobets; John N. Tengler, both of Chico, Calif.

[73] Assignee: Minnesota Mining and Manufacturing Company, St. Paul, Minn.

[21] Appl. No.: 897,112

[22] Filed: Aug. 14, 1986

[51] Int. Cl.[4] ..... H01R 13/56

[52] U.S. Cl. ..... 439/447; 439/494

[58] Field of Search ..... 339/101, 102 R, 102 L, 339/103 R, 103 M; 174/135, 153 G; 439/445–448, 494

[56] References Cited

U.S. PATENT DOCUMENTS

| | | | |
|---|---|---|---|
| 2,949,642 | 8/1960 | Lieberman | 339/218 R |
| 3,051,774 | 8/1962 | Schelke | 174/135 R |
| 4,203,004 | 5/1980 | Cox | 339/101 |

FOREIGN PATENT DOCUMENTS

| | | | |
|---|---|---|---|
| 1105275 | 11/1955 | France | 339/101 |
| 25972 | of 1904 | United Kingdom | 339/101 |

*Primary Examiner*—Neil Abrams

*Attorney, Agent, or Firm*—Renner, Otto, Boisselle & Lyon

[57] ABSTRACT

A strain relief and a cable termination assembly using the same. The strain relief includes tapered beams for minimizing stress applied to a cable during relative movement, particularly angular movement, namely bending, of the cable and a cable termination; the tapered beams undergo controlled bending according to a prescribed function, a securing mechanism secures the tapered beams to the cable termination, and a holding mechanism holds the beams with respect to the cable to control the bending thereof. A low profile cable termination assembly and a printed circuit termination assembly also are disclosed.

20 Claims, 29 Drawing Figures

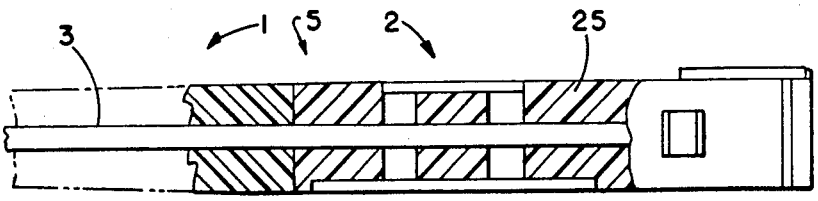
FIG. 5
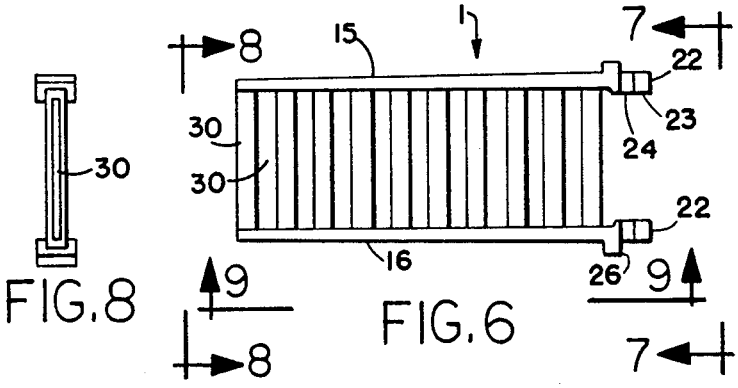
FIG. 6
FIG. 8
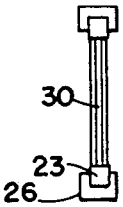
FIG. 7
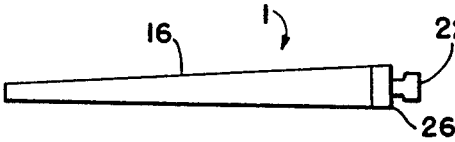
FIG. 9
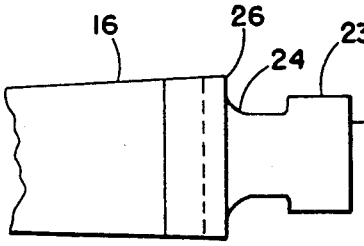
FIG. 10
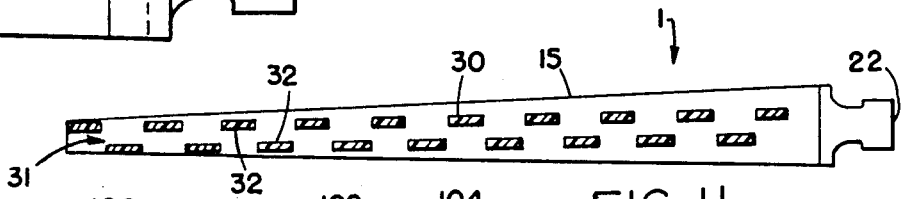
FIG. 11
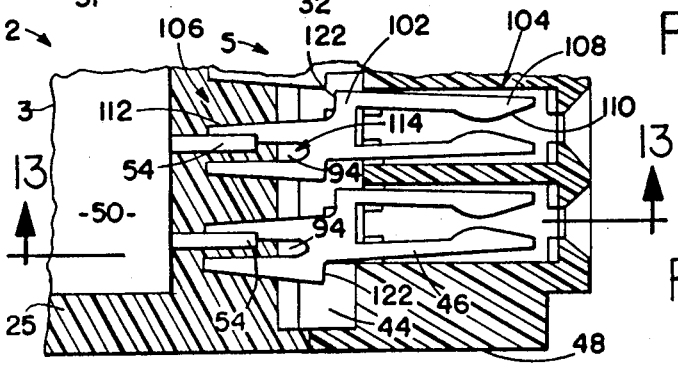
FIG. 12

TAPERED STRAIN RELIEF ELECTRICAL INTERCONNECTION SYSTEM

TECHNICAL FIELD

This invention relates generally, as indicated, to strain relief devices and, more particularly, to strain relief devices in a cable termination assemlby. The invention also relates to a low profile cable termination assembly and to a printed circuit board termination assembly.

BACKGROUND

It is well known to provide strain relief mechanisms for cable termination assemblies and the like. Conventional strain relief mechanisms for cable termination assemblies that include an electrical cable and a cable termination (connector or the like) have been used in the past to prevent or to reduce applying stress to the junctions of contacts and cable conductors, which are respectively coupled to each other, when a force is applied in such a manner that tends to separate the cable from the cable termination. Some strain relief mechanisms tend to prevent or to reduce stress applied to such junctions also in the situation that angular relative movement of the cable and cable termination occurs, e.g. the cable being flexed relative to the generally elongate axis thereof at or proximate the cable termination or where the cable exits the cable termination.

One form of strain relief mechanism includes the forming of openings through the cable and molding a strain relief body to the cable and to the cable termination to form an integral structure thereof such that at least some of the molding material enters such openings in the cable and tends to lock the same in place relative to the subsequently solidified molding material and the cable termination. Another form of strain relief mechanism is a curved surface at the place in a molded strain relief body of a cable termination assembly that the cable exits the cable termination; such curved surface tends to distribute forces as the cable is flexed and/or is pulled to minimize stress applied to the mentioned junctions. The foregoing are examples of the various types of strain relief mechanisms used in the past and currently, as well.

It has been found that cable termination assemblies may too often encounter breaking of one or more of the cable conductors when the cable is flexed relative to itself or relative to the cable termination, e.g. where the cable exits the cable termination at too great an extent, too many times and/or at too sharp an angle. Another relatively recent experience with the advent of coaxial cables, especially multiconductor ribbon coaxial cables, in addition to the possible breakage of a conductor, is the loss of accurate control of cable impedance due to flexing of the cable, especially at a relatively sharp angle, that damages the insulation between the coaxial conductors. Accordingly, it would be desirable to avoid damage to a cable and/or to the junctions of the conductors thereof with contacts, circuits, etc., regardless of whether of the coaxial or other type when such flexing or the like is encountered.

A card edge connector is an electrical connector used to connect with the conductive printed circuit traces that terminate proximate the edge of a printed circuit board or the like. Typically a card edge connector has plural resilient contacts to connect with such traces and to couple the same to other printed circuit traces on another printed circuit board, e.g. in a mother board-/daughter board arrangement, or to the conductors of an electrical cable, and so on. Sometimes the stress and other problems encountered in a cable termination assembly also can be encountered in a card edge connector/printed circuit board assembly, especially when it is desired to maintain a secure, relatively permanent connection of the printed circuit board and contacts of the card edge connector. It would, of course, be desirable to minimize such problems in such devices.

BRIEF SUMMARY

According to one aspect of the present invention an improved strain relief arrangement is provided, for example, for electrical cables and, more particularly, for cable termination assemblies. Such strain relief arrangement of the invention is especially useful to enable controlled flexing or bending of a cable while avoiding damage to the conductors thereof and/or to the insulation thereof even when the cable flexed a relatively large number of times.

The fundamental features of the strain relief arrangement of the invention include a tapered beam for undergoing controlled bending according to a prescribed function, a securing mechanism for securing the tapered beam to a cable termination, and a holding mechanism for holding the tapered beam with respect to the cable of the cable termination to control the bending thereof in either direction, as is evident from the drawings hereof. Such features are especially useful in conjunction with a coaxial cable used with a cable termination assembly, especially a multiconductor ribbon coaxial cable, for example to restrict bending and, thus, distortion of the spacing relation of the ground and signal conductors of such cable.

According to another aspect of the invention, a cable termination assembly includes a cable termination, a multiconductor electrical cable, and a strain relief including the aforesaid tapered beam, securing mechanism and holding mechanism.

According to a further aspect, the tapered beam mechanism includes a plurality of tapered beams or rails, respectively on at least two sides of the cable, and the holding mechanism includes a ladder-like structure to couple together the tapered beams, to mount them relative to the cable and to distribute forces with respect to the cable.

An important aspect of the invention is to minimize stress on the cable when the cable is bent, e.g. relative to a cable termination. By minimizing stress, the cable, particularly the conductors thereof, will remain in the elastic range and will be capable of a relatively large number of flexes without failure, e.g. caused by breaking of one of the cable conductors.

To minimize such stress due to bending of a cable, it is desirable, according to the invention, to distribute the stress over a relatively large extent of the cable and most preferably to effect such distribution uniformly. To achieve such uniformity the cable bending, say a 90 degree bend, should be along a 90 degree arc that has a constant and a maximum radius of curvature, e.g. following a circle. Desirably, such radius of curvature and uniform bending results in a relatively gradual curve in the cable such that stress to all parts of the cable along such bend or arc is substantially the same (uniformly distributed) and at the beginning and end of the arc the cable is at least substantially tangent to the arc.

The length of the tapered beam(s), degree of taper, flexibility/stiffness of the tapered beam(s) and material of which made, and the radius of curvature are parameters that can be varied and/or selected to achieve a particular stress distribution function and curvature characteristics for a particular force or maximum force applied in such a way as to tend to bend the cable and strain relief. The resiliency/stiffness characteristics of the cable itself also may impact on the operation of the strain relief cooperating therewith to achieve a desired operational (curve and force distribution) characteristic, for example. A specific example of strain relief is presented in the following description, but it will be appreciated that other values for such parameters may be selected and/or determined empirically and/or mathematically.

An additional aspect of the invention relates to a low profile cable termination assembly which includes a multiconductor electrical cable having plural electrical conductors and insulation, plural electrical contacts for effecting electrical connection between a respective conductor of the cable and a further member, the electrical contacts having a connecting portion for connecting with a respective conductor of the cable and having a contacting portion for contacting with such further member, a carrier for carrying the contacts, the carrier including plural parallel fingers for supporting the contacts in one plane while permitting freedom of movement thereof in a direction parallel to that one plane, a space between respective adjacent fingers, and a base for holding the fingers in relative position, the contacting portion being positionable to extend in a generally parallel overlying relation with a respective finger, the electrical contacts being arranged in a pair of parallel rows, the contacting portions in one row being arranged in spaced apart parallel relation to the contacting portion in such other row, and each connecting portion of the electrical contacts including a connecting portion arranged in a pair of respective parallel rows spaced apart a distance less than the spacing of the contacting portion, a housing for holding together in snap fit relation the carrier and contacts, and the connecting portions being relatively truncated to limit the extent the same extend beyond the end of the carrier opposite from the fingers.

Consistent with the foregoing aspect of the invention, the cable may be of the ribbon coaxial type having a plurality of ground conductors and a plurality of signal conductors, the ground conductors being connected to the connecting portions in one row and the signal conductors being connected to the connecting portions in the other row.

Still another aspect of the invention relates to a printed circuit board termination assembly. Such an assembly includes a printed circuit board having plural printed circuit conductor traces thereon, plural electrical contacts for effecting electrical connection between a respective conductor of the the printed circuit board and a further member, the electrical contacts having a connecting portion for connecting with a respective conductor of the printed circuit board and having a contacting portion for contacting with such further member, a carrier for carrying the contacts, the carrier including plural parallel fingers for supporting the contacts in one plane while permitting freedom of movement of the contacts in a direction parallel to the one plane, a space between respective adjacent fingers, and a base for holding the fingers in relative position, the contacting portion being positionable to extend in a generally parallel overlying relation with a respective finger, the electrical contacts being arranged in a pair of parallel rows, the contacting portions in one row being arranged in spaced apart parallel relation to the contacting portions in such other row, and the connecting portions of the electrical contacts including a connecting portion arranged in a pair of respective parallel rows spaced apart a distance less than the spacing of the contacting portions, a housing for holding together in snap fit relation the carrier and contacts, and the printed circuit board being positioned between the parallel rows of the connecting portions and further including connections between respective circuits on the printed circuit board and the connecting portions.

The foregoing and other aspects, features, objects, and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 5 is a fragmentary section view of the cable termination assembly and strain relief of FIGS. 1–4, looking generally in the direction of the arrows 5—5 of FIG. 3;

FIGS. 6–9 are, respectively, top, front end, back end, and side views of the strain relief according to the invention looking generally in the direction of the corresponding arrows;

FIG. 10 is an enlarged fragmentary side view of the securing portion of the strain relief;

FIG. 11 is a section view of the strain relief of FIG. 6 looking generally in the direction of the arrows 11—11;

FIG. 12 is a side elevation view, partly broken away in section, of a cable termination assembly according to the present invention;

DESCRIPTION OF THE PREFERRED EMBODIMENT

Figures 1, 2, 3, 4:
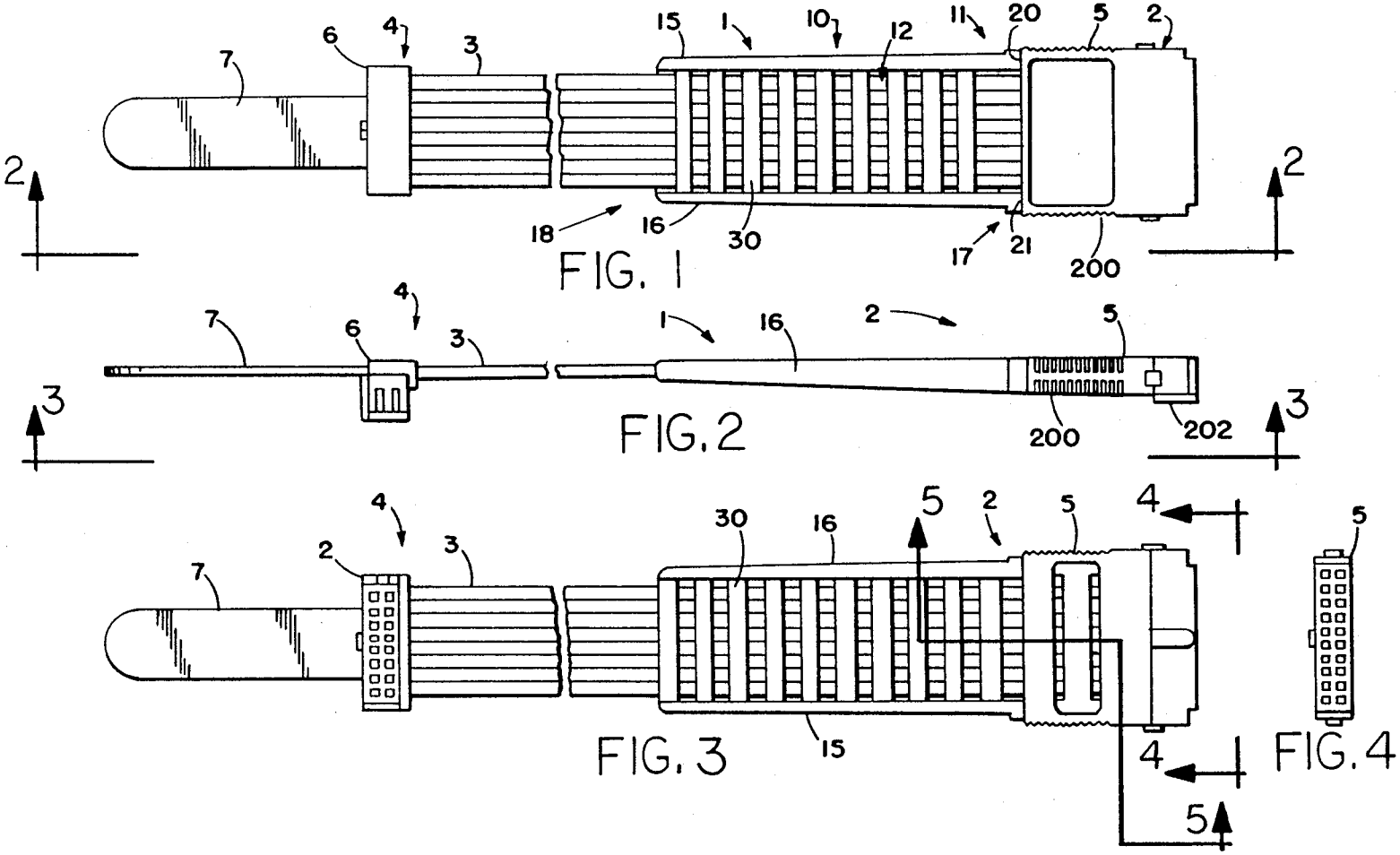
FIG. 1 is a top plan view of a cable termination assembly and strain relief in accordance with the present invention and of a low profile cable termination assembly connector also in accordance with the invention.
FIGS. 2–4 are, respectively, side, bottom, and end views of the cable termination assembly, strain relief and low profile connector of FIG. 1, looking generally in the direction of the respective corresponding arrows shown.

Referring, now, in detail to the drawings, wherein like reference numerals designate like parts in the several figures and wherein various parts shown in respective embodiments may be included in other respective embodiments, a strain relief 1 for a cable termination assembly 2 at one end of a multiconductor cable 3 and a low profile cable termination 4 at the other end of the cable 3 are illustrated in FIGS. 1–3. The cable termination assembly 2 includes the cable 3 and a cable termination 5; and the cable termination assembly 4 includes the cable 3 and a low profile cable termination 6. A pull tab 7 of conventional style may be connected to the cable termination 6 to facilitate removing the latter from connection with a socket or the like.

For purposes of the following description it is noted that the cable 3 is a multiconductor ribbon coaxial cable having plural coaxial cables contained as part thereof, each including a signal conductor and a ground conductor. As usually is the case, such coaxial cables includes insulation between the signal and ground conductors intended both to maintain the same in positional and in relatively ellectrically insulated relation and also to provide a relatively controlled impedance characteristic. However, it will be appreciated that the principles of the invention, as will become more apparent from the following description, may be used with other types of multiconductor ribbon cable that are not of the coaxial type, with other types of multiconductor cable that are not necessarily of the flat or ribbon type, with single conductor cable or single coaxial cable, etc.

Referring to FIGS. 1–3 and 5–11, the fundamental components of the strain relief 1 include a tapered beam arrangement 10 for undergoing controlled bending according to a prescribed function, a securing mechanism 11 for securing the tapered beam arrangement 10 to the cable termination 5 of the cable termination assembly 2, and a holding mechanism 12 for holding the tapered beam arrangement with respect to the cable 3 to control the bending thereof.

According to the preferred embodiment, the tapered beam arrangement 10 includes a pair of tapered beams or rails 15, 16 that are of a relatively resilient material capable of bending in a controlled manner as a function of the characteristics of the material itself and of the tapered cross section thereof. The bending to which reference is made here is, for example looking at FIG. 2, the bending that would occur when the front end 17 and back end 18 of the tapered beam arrangement 10 are moved angularly relative to each other, i.e. up or down relative to the illustration in FIG. 1. Thus, as an example, the front end 17 may be held fixed and a force may be applied to the back end 18 of the tapered beam arrangement 10 tending to move the latter downward, e.g. toward the illustration of FIG. 3 in the drawing. As a result of such force, and also as a result of the bending characteristics of the tapered beams 15, 16, the strain relief 1 will curve relatively gradually and substantially uniformly. Therefore, application of a sharp bend of small bend radius that would tend substantially to apply stress to the cable, the conductors and/or insulation thereof, and/or the cable (and conductors) relative to the cable termination 5 (and contacts thereof) importantly is avoided.

Each of the tapered beams or rails 15, 16 is tapered in height, e.g. vertical height looking at FIG. 2, from a relatively thick cross section proximate the front end 17 at and/or relatively proximate the cable termination 5 to a relatively thinner cross section (height) at and more proximate the back end 18. Such tapering in cooperation with the stiffness and various other characteristics of the material of which the beams 15, 16 are made determine the bending caracteristics of the respective beams and, accordingly, of the strain relief 1.

The beams 15, 16 may be tapered in one or in two directions as desired. That is, the tapering may be in the height direction illustrated in FIG. 2 and/or in the thickness direction, e.g. across or transverse to the axial direction of the flat cable 3. The thicker part would be proximate the termination 5 and the thinner part would be more remote therefrom. However, the height dimension taper seen in FIG. 1 provides the greater impact and the more controlled one than does the thickness taper.

The securing mechanism 11 includes a molded connection 20, 21 between the cable termination 5 and the tapered beams 15, 16. More specifically, each tapered beam has a locking protrusion 22 with an enlarged head 23 and an undercut or groove 24, as is seen in Figs. 6 and 9. The cable termination 5 includes a molded strain relief body 25, which is described in further detail below, that is molded about such locking protrusions. Material of which the strain relief body 25 is molded encircles the protrusion 22, including the enlarged head 23, and fills the undercut or groove 24 thereby to hold the tapered beams securely to such strain relief body. If desired, other means may be employed to secure the tapered beam strain relief 1 to the cable termination 1.

Directly behind the protrusion 22 is an enlarged surface and stop 26 which may be used during molding of the strain relief body 25, e.g. for a mold shut off function, and which also may be used to tend to spread force against the back end of the molded strain relief body as the tapered beam strain relief 1 and the cable termination 2 are moved, e.g. angularly, relatively to each other.

The holding mechanism 12 holds the pair of tapered beams 15, 16 relative to each other and relative to the cable 3. According to the preferred embodiment, the holding mechanism includes a plurality of transverse members 30 that extend between and are connected to the tapered beams 15, 16. Preferably the members 30 extend across the cable 3 in a direction transverse to the generally linear or axial extent of the cable. Moreover, at least one of the members 30 is on one side or proximate one surface of the cable 3 and at least one other of the members 30 is on the opposite side or proximate the opposite surface of the cable 3, as is clearly seen in the drawings.

Preferably there are a plurality of members 30 on each side of the cable 3 thereby effectively forming with the tapered beams 15, 16 a ladder-like structure. Also, as is seen in FIG. 11 in particular, the members 30 are arranged in two different rows to define a gap 31 between generally parallel rows of members 30; the cable 3 may be slid into such gap between such rows of members 30. Accordingly, the members 30 hold the strain relief 1 to the cable and the strain relief 1 extends generally along the axial direction of the cable. The members 30 may be staggered in alternating arrangement, as is illustrated in FIG. 11 such that along the axial extent of the strain relief boot 1 the members 30 in one row are relatively offset from the members in the other row; alternatively, the members 30 in the respective rows may be directly aligned with each other, although this form would be rather difficult to manufacture using molding processes. Preferably the strain relief 1 is manufactured using injection molding techniques.

Moreover, preferably the members 30 have relatively broad surfaces 32, particularly along the axial direction of the cable. Such broad surfaces confront the surface of the cable in a way that tends to spread force along the surface of the cable. Therefore, excessive force concentration that might otherwise occur at a relatively small or narrow interface of the members and cable and could damage the cable, especially by excessive application of force to a coaxial cable that has a relatively fragile insulation material between the signal and ground conductors thereof is avoided.

Although the holding members 30 tend to hold the strain relief 1 to the cable, the tapered beams 15, 16 also cooperate with the members 30 to locate the cable between the two rows of members 30 and to retain the cable therebetween. As illustrated, ten members 30 are illustrated in one row thereof and nine are in the other row. The larger the number of members 30 generally longer will be the strain relief 1 and the greater the extent that force during bending can be spread over the strain relief and cable; also, the longer can be the tapered beams 15, 16 to provide the desired control of bending. The number of members 30 in each row can be more or less than the number illustrated, the length of the strain relief 1 can be more or less than illustrated, and the extent of taper of the tapered beams 15, 16 can be more or less than that illustrated in accordance with the principles of the present invention.

The strain relief 1 preferably is formed of flexible polyester using plastic injection molding techniques. However, other materials having desired and/or equivalent flexibility characteristics also may be used.

For continuity, aesthetics, uniformity, strength, and so on, it is desirable that the height of the rails 15, 16 adjacent the cable termination 2 should be the same as that (as viewed vertically in FIG. 1) of the cable termination 5. The height of the rails 15, 16 at the back end 18 thereof should be at least slightly thicker than the cable 3 thickness to provide place for the alternating arrangement of holding members 30 at least one of which is proximate the back end 18 of the strain relief 1.

According to the preferred embodiment of the invention, the rails are uniformly tapered in height from the front end to the back end, i.e. the top and bottom surfaces of the rails follow a generally straight line from the front end to the back end. Using such a tapered configuration, heights, and lengths generally as shown substantially proportionally in FIGS. 1–4, and molded flexible polyester, it has been found that while the cable termination 5 is held in the horizontal position illustrated in FIG. 1, application of a one pound weight to an end of the cable 3 beyond the back end 18 of the strain relief 1 will cause the strain relief and the cable 3 to bend uniformly over an arc of approximately 90 degrees with a substantially radius of curvature such that the cable 3 at the cable termination 5 and at the back end 18 substantially tangent to such arc.

Although the preferred taper in the rails 15, 16 is linear, as is seen in FIG. 1, it will be appreciated that such taper may be somewhat curved, either concavely or convexly, or may be non-uniform, depending on the desired bending characteristics therefor.

The cable termination assembly 2 will be described below with reference to FIGS. 12–22. Reference is made here to commonly owned U.S. patent application Ser. No. 816,551, filed Jan. 6, 1986, the entire disclosure of which is hereby incorporated by reference. Such application discloses a number of principles and features embodied in the cable termination assembly 2.

The fundamental components of the cable termination assembly 2 include the multiconductor electrical cable 3 and cable termination 5, which includes a contact carrier 44, plural electrical contacts 46, a cover or housing 48, and a strain relief body 25. Such parts 44, 46, 48 preferably are plastic pre-molded parts using plastic injection molding techniques. Such parts 44, 46, 48 can be assembled to form the cable termination 5.

In operation of the cable termination assembly 2 the contacts 46 connect respective conductors of the cable to external members such as further contacts to effect electrical connection thereof, as is well known. The cable termination assembly 2 is particularly suitable for high speed signal transmission use in that the cable preferably has plural signal conductors physically and electrically/electromagnetically separated by one or more ground conductors; and the arrangement of the contacts 46 in the assembly and the efficient connection provided the ground conductors generally maximizes the desired ground isolation function. Moreover, the relatively low profile nature of the cable termination assembly further tends to enhance the ground isolation function. As is described further below, the arrangement of conductors and contacts and the interconnection techniques employed therewith enhance the mechanical and electrical integrity of the cable termination assembly 2 while facilitating manufacturing.

The multiconductor cable 3 is of the flat ribbon coaxial type. The cable 3 includes external electrical insulation 50, for example of PVC (polyvinyl chloride), internal electrical insulation (not shown), for example of Teflon or other material that has suitable electrical insulating, durability, etc. characteristics, and pairs of signal conductors 54 and ground conductors 55. Teflon material insulation has been found particularly useful for high speed signal transmission cable. The respective pairs of electrical signal conductors 54 and ground conductor s55 are held in spaced apart electrically separated locations in the cable by the internal insulation, as is well known.

The contact carrier 44 is intended to support and to carry the contacts 46 prior to assembly with the cover 48 and to continue to provide a measure of support for and physical separation of the contacts after assembly with the cover 48 and during use of the cable termination 5. Importantly, the carrier 44 preferably may be snap fit at least partly into the cover 48 and assembled with respect to the cover in such was to cooperate with the cover to hold the contacts 46 relatively securely while the signal and ground conductors 54, 55 are attached to the contacts and while the strain relief body 25 is molded, as is described in further detail below.

Figure 15:
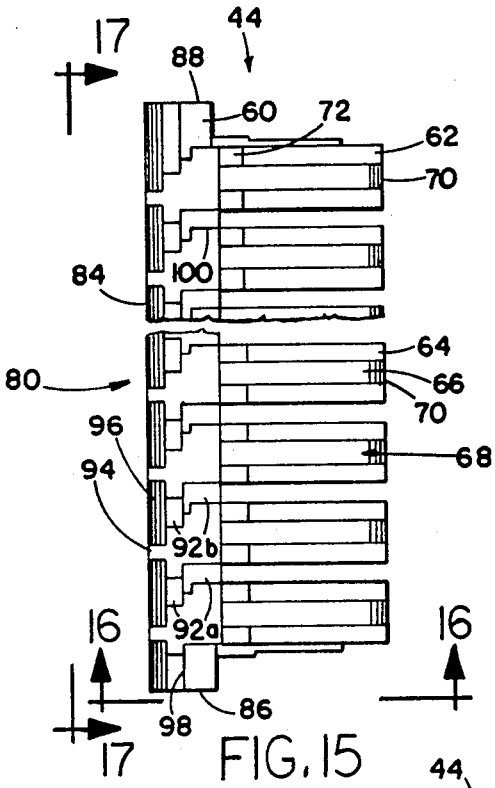
FIG. 15 is a side elevation view of a contact carrier support for the cable termination assembly.
Figure 17:
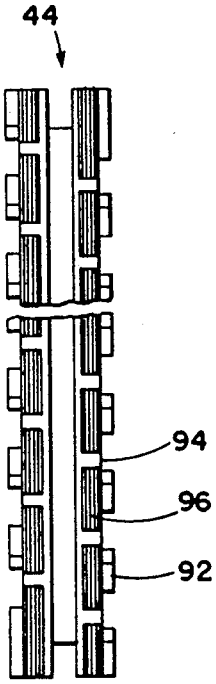
FIG. 17 is a top or back view of the contact carrier support.
Figure 16:
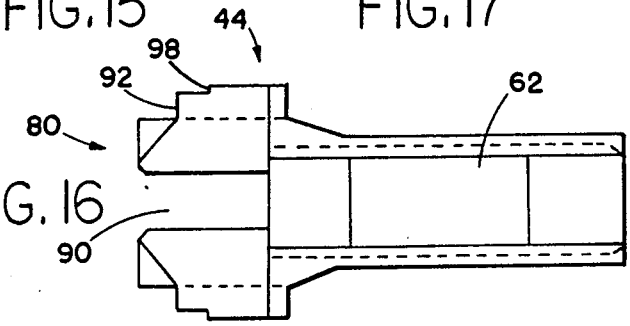
FIG. 16 is an end elevation view of the contact carrier support of FIG. 15, looking generally in the direction of the arrows 16—16 of FIG. 15.
Figure 22:
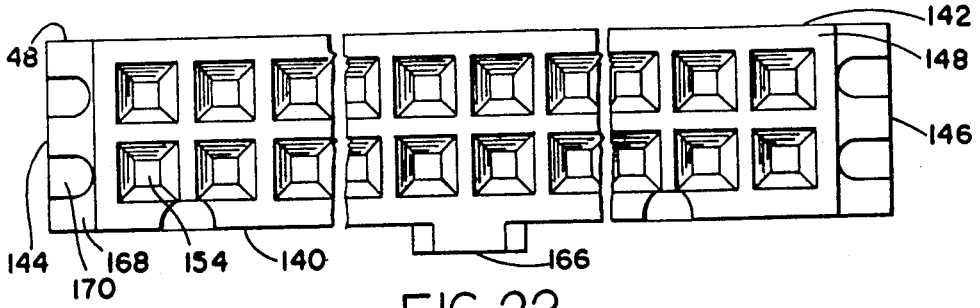
FIGS. 18–22 are, respectively, side, end section, end, bottom, and top views of the cover for the cable termination assembly.
Figure 18:
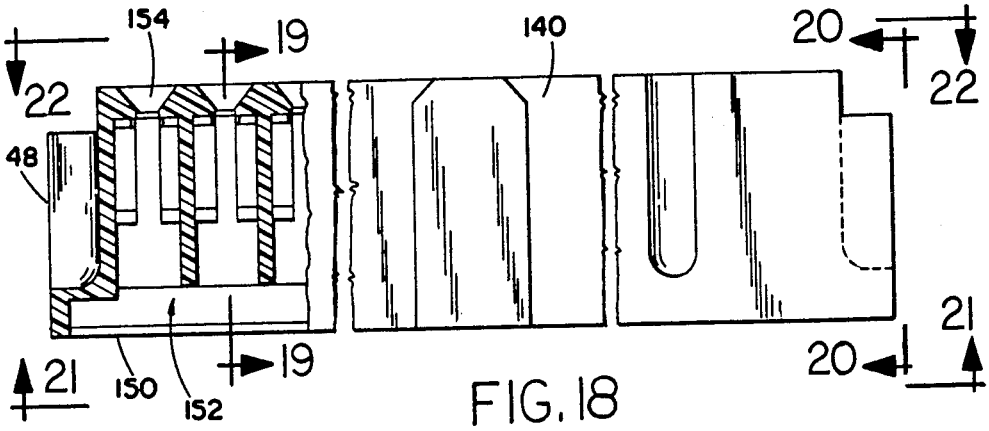
Figure 21:
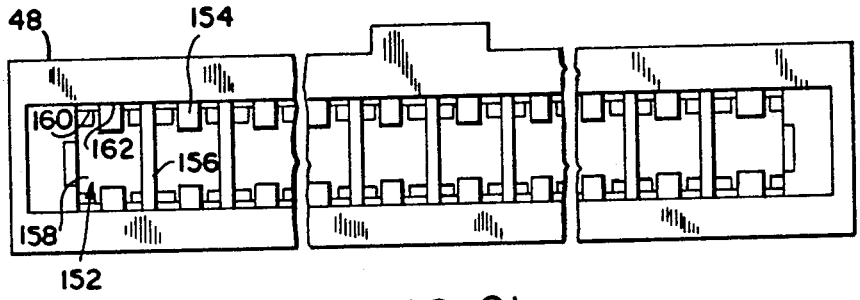
Figure 19:
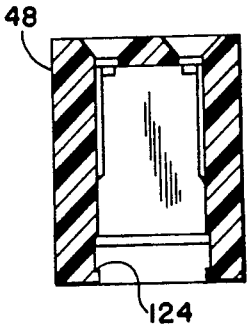
Figure 20:
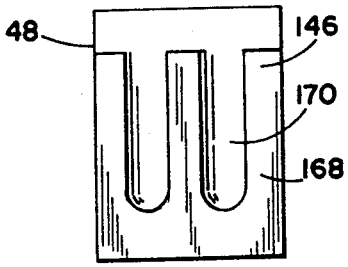

The contact carrier 44 is made of electrically non-conductive material, such as polyester material. The width of the carrier (vertical direction as seen in FIG. 15) is a function of the number of contacts 46 to be carried thereby.

Figure 13:
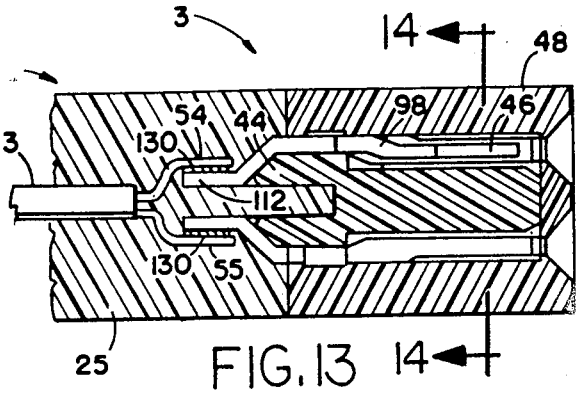
FIG. 13 is a section view of the cable termination assembly of FIG. 12 looking generally in the direction of the arrows 13—13 of FIG. 12—the left-hand contact cell in the cable termination assembly of FIG. 13 is shown for convenience without an electrical contact therein, and the right-hand contact cell is shown with an electrical contact therein.

The contact carrier 44 includes a main body portion 60 and a plurality of finger-like projections 62 that extend from the main body, each projection corresponding to and cooperative with a respective contact 46 or pair of contacts (one on each side) to provide support, positioning, and various other functions with respect thereto, as is described further herein. The main body portion 60 extends generally across the width or lateral dimension of the cable termination assembly 40, and each of the projections 62 projects from the main body portion 60 generally in the axial direction of the cable termination assembly. In use of the carrier 44, the projections 62 and at least part of the main body portion 60 extend into the cover 48, for example, as is seen in FIGS. 12–14.

Each finger-like projection 62 has a pair of relatively raised fork contact tine support/guide surfaces 64 and a relatively recessed pin contact guide surface 66 between the surfaces 64. The contacts 46 are of the fork contact type having a pair of tines, each of which is intended to align generally over a respective support/guide surface 64. The recessed surface 64 and the space 68 between the surfaces 64 cooperate to guide a pin contact (not shown) or other similar external member to properly aligned physical and electrical engagement with the tines of the contact 46. A chamferred lead in wall 70 at the leading end of the recessed surface 66 provides further guidance for insertion of a pin contact into the cable termination 5. At the end of the surfaces 64 proximate the main body are sloped surfaces 72, which lead up to the plane level of the main body portion 60.

Figure 14:
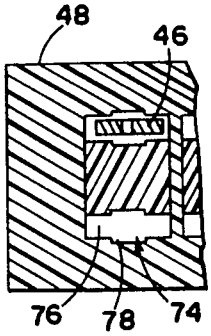
FIG. 14 is a section view of the cable termination assembly looking generally in the direction of the arrows 14—14 of FIG. 13.

The surfaces 64, 66 of each finger-like projection 62 cooperate with corresponding surfaces within the cover to define a cross core zone 74 (FIG. 14). Such cross core zone provides relatively narrow lateral and thickness defined or limited areas 76 along the axial extents of both tines of the contact 46 that permits minimal, but adequate, deformation and travel of the contact 46 tines, while providing support thereof and restricting the maximum tine deformation to avoid an over travel condition that would permanently deform the contact beyond its elastic limit. On the other hand, at the central area of the cross core zone 74, i.e. between the tines, is a relatively wide open space 78 defined in part by the recessed surface 66 and a corresponding surface of the cover 48 that permits limited non-axial alignment of the inserted pin contact while guiding the same to proper engagement with the tines of the fork contact 46.

Since it is preferred, according to convention, that contacting portions, i.e. the tines, of the contacts 46 be arranged generally in a dual-in-line pattern, each of the finger-like projections 62 is generally identically formed on both the top and bottom lateral surfaces, only the top surface being illustrated. However, the top 80 and bottom lateral surfaces of the main body portion 60 of the contact carrier 44 are similar to each other but are of opposite phase in order to provide retention of the contacts 46 on both surfaces thereof while enabling the connecting ends of each pair of contacts supported by or aligned with a particular projection 62 to be laterally offset with respect to each other. Such offset permits each such pair of contact to connect respectively with the signal and ground conductors of one coaxial cable in the ribbon cable 3 while spacing the ground and signal conductors and minimizing the free distance such conductors must extend between leaving the cable insulation and the attachment point to the respective contacts 46.

To retain the electrical contacts 46 on the top surface 80 of the contact carrier 44, a number of stepped or offset walls generally designated 92 are formed on such surface. Specifically, relatively adjacent stepped walls, such as those designated 92*a*, 92*b* cooperate with a main base portion of a contact placed therebetween to retain the contact in place. For additional contact positioning function, a tab 94 protrudes out of the lateral surface 80 beyond the chamferred plane of sloped walls 96 proximate the axially trailing edge 84 of the carrier 44. The tab 94 fits in a slot between the bifurcated arms of the contact connecting portion. The stepped walls 92 proximate the left and right ends 86, 88 of the carrier 44 are continuous to such ends.

The arrangement of stepped walls 92 and tabs 94 for positioning and retaining contacts 46 on the contact carrier are different on the opposite lateral surfaces and may be referred to as being oppositely out of phase. That is, along the lateral or width dimension of the carrier the tabs 94 on one surface, e.g. surface 80, are located half way between a pair of tabs on the other surface. Similarly, the offset or stepped positioning and retaining walls 92 on one surface face the opposite direction, i.e. are reversed, from the facing direction of the stepped walls 92 on the other surface and, of course, are appropriately aligned with respect to each other and corresponding tabs 94 for proper positioning and retention of contacts 46 thereby.

The sloped walls 96 proximate the axially trailing edge 84 of the contact carrier accommodate a bend in the connecting end of the contacts. Such bend allows the connecting ends of the contacts in both rows to be positioned relatively close to each other to receive the cable conductors for attachment thereto.

Part of each stepped offset wall 92 is in one plane and part is in another generally parallel panel with a small step 98 separating the two planes. Such step 98 and the relatively raised part 100 of the offset wall 92 are provided to cooperate with a corresponding recessed area in the cover 48 for a snap fit retention of the carrier 44 (and contacts 46 thereon) to the cover 48.

Each contact 46 (as is seen in FIG. 12) has a main base portion 102, a contacting portion 104 and a connecting portion 106. The contacting portion 104 includes a pair of generally linearly extending tines 108 as in the case of a typical fork contact, each tine having a curved contacting area 110. A pin contact ordinarily would be inserted between the tines 108 to engage the contacting areas 110 making an electrical connection with the fork contact. The connecting portion 106 extends away from the base 102 generally in the opposite direction fron which the contacting portion 104 extends. The connecting portion is bifurcated and includes a pair of legs 112 defining a slot 114 therebetween. The slot 114 includes a relatively wide portion proximate the base 102 for receiving therein a tab 94 of the contact carrier 44 and a relatively narrow portion. A signal conductor 54 is soldered to the connecting portion 106 of each contact in one row thereof; and a ground conductor is soldered to the connecting portion 106 of each contact in the other row. Preferably the signal and ground conductors 54, 55 found in one coaxial cable in the ribbon cable 3 are respectively connected to directly opposed contacts 46 in the respective opposite rows thereof.

Preferably each contact 46 has an offset bend 118 (FIG. 13) at the area where the tines are proximate the base and/or at the base itself to enable the tines to follow relatively closely the sloped wall 96 and the linear walls 64 of the finger-like projections 62 of the contact carrier 44. Also, the contact base 102 and/or legs 112 are bent to follow the shape of the contact carrier 44 and to place the connecting portions 106 of the paired contacts in the two parallel rows thereof relatively proximate each other for close fitting with the cable 3 conductors 54, 55.

Furthermore, the contacting and connecting portions as well as the base portion of the contacts 46 have the illustrated shoulders 122 which together with the generally linearly extending proximate portions of the tines and/or legs 112 cooperate with the stepped offset wall portions 92 of the contact carrier 44 to result in proper positioning and retention of the contacts on the contact carrier 44. Moreover, plural contacts 46 may be attached to a temporary support strip, not shown, forming a so called contact comb. The support strip holds such contacts relative to each other and facilitates the retention of the contacts on the carrier 44 prior to insertion of the contacts and carrier into the cover 48. After such insertion the support strip may be broken away at weakened zones thereof and discarded leaving the connecting portions 106 available for connection with respective conductors 54, 55. The conductors 54, 55 may be placed generally centrally of the parallel legs 112 bordering the slot 114 as long as the respective conductor touches at least one of the legs for connection thereto; alternatively, the conductors may be placed on only one of such legs 112 of a respective contact 46 to assure maximum surface area engagement therewith for good electrical connection thereof.

As is seen in FIG. 13, solder 130 may be coated on the contacts; and such solder may be reflowed using various techniques that apply appropriate heat for such purpose to join each conductor 54, 55 mechanically and electrically with the respective legs 112. In one example such reflowing of the solder may be accomplished by induction heating, either before or after the strain relief body 25 has been molded in place; in other examples heat may be applied by a laser or by a conventional soldering instrument. Alternatively, the solder may be applied separately without having been pre-coated on the contacts. Further, instead of solder connections, the conductors 54, 55 may be welded to the contacts or may be otherwise mechanically and electrically connected with respect to the contacts. Moreover, if desired, particulary if the cable 3 is of the flat ribbon, non-coaxial type, e.g. of Teflon insulation or of PVC (polyvinyl chloride) insulation, the use of the knuckles and/or strain relief slits and the overall mechanical, electrical and strain relief connections disclosed in the above-mentioned application Ser. No. 816,551 may be employed in the cable 3 and overall cable termination assembly 2 described herein. Such strain relief slits are particularly advantageous if the cable insulation is Teflon or like material that does not bond with the material of which the strain relief body 25 is molded.

The cover 48 covers the contacting portion of the contacts 46 and cooperates with the contact carrier 44 to form a cross-core cell 74 to constrain movement of the contact tines and to guide a pin contact properly to engagement with the contact tines. By constraining such movement of the contact tines, the possibility of damage to the contacts 46 during insertion of a pin contact that is misaligned or is slightly over-sized and/or the possibility of further misalignment damage to such pin contact are minimized.

Accordingly, the cover 48 has lateral walls 140, 142, left and right end walls 144, 146, front wall 148, bottom wall 150, and a hollow interior area 152. Openings 154, which are tapered, as shown, provide access for a pin contact to be inserted into the interior of the cover, more particularly to a particular cross core cell 74 for engaging a fork contact 46 therein. Divider walls 156 separate respective adjacent cell pair areas 158 in the interior 152 of the cover 48. Thus, in each cell pair area 158 one of the finger-like projections 62 of the contact carrier 44 is inserted to form a pair of cross-core cells. Within each cell pair area of the cover 48 are several tine support/deformation limiting surfaces 160 on opposite sides of each opening 154 that cooperate with the raised surfaces 64 of the contact carrier finter-like projections 62 to define the cross-core configuration of each cell 74. The openings 154 have one wall that leads as a smooth transition to the interior of a lateral wall 140, 142 of the cover to provide a recessed area 162 between each pair of raised surfaces 160.

A shallow recess or groove-like area 162 is formed in the interior faces of the lateral walls 140, 142 to cooperate with the wall or surface 100 of the contact carrier 44 to hold the latter in place in the cover in snap fit relation. Various key-like and tablike protrusions and recesses, such as those designated 166, 168, 170, may be provided on the cover 48 for proper polarity and/or other positioning control when the cable termination assembly is connected with another socket, cable termination assembly or the like, not shown, during use thereof.

As part of the process of making the cable termination assembly 2 of the invention, respective combs of contacts 46 are placed on the respective opposite sides of the contact carrier 44 and are held in position thereon as aforesaid; the contact carrier and contacts are then inserted into the cover 48 to the mentioned snap fit relation, thereby forming a contact carrier, contacts, and cover sub-assembly. The conductors 54, 55 then are connected to the respective contacts 46, e.g. by soldering. Finally, the strain relief 1 is slid onto the cable 3 to place the protrusions 22 in engagement with the back end of the cover 48 and/or carrier 44. The strain relief 1, then, in a sense is like a boot placed on the cable; and after such placement the strain relief body 25 can be molded in place.

Importantly, due to the ability essentially to pre-assemble the sub-assembly just described and to secure the cable with respect thereto, both by the placement of the contacts 46 and by connection of the conductors 54, 55 to the contacts, there is a secure positioning of the cable and sub-assembly prior to the step of molding of the strain relief body 25. Therefore, during such molding the possibility that the flowing molding material would interfere with the proper positioning and connection of the various other parts of the cable subassembly and connected/positioned cable is minimized. Also, secure attachment of the strain relief boot 1 to the strain relief body 25 is readily effected.

Preferably the strain relief body 25 is formed of electrically non-conductive material that is molded directly to and about the junctions of the contacts 46 and respective conductors 54, 55 to form a hermetic, i.e. air and moisture free, seal thereof to maintain the integrity of the connections therebetween. Moreover, at least some of such molding material may penetrate into the area of the slot 90 of the carrier 44 to fill up space therein. Especially when the cable 3 is of the coaxial type or of another type that can deform under the pressure of direct molding of a strain relief body 25 or the like thereto, it is desirable to provide openings 25*a* in the strain relief body, e.g. by cores in the mold, to minimize the amount of molding material that is applied under pressure directly to the cable; also, such cores may be used to hold the cable in proper place during such molding operation avoiding movement that could damage the junctions of the conductors and contacts and/or damage the internal insulation of the cable.

The material of which the strain relief body 25 is made may be of a type that bonds with the cable insulation and/or with the material of which the contact carrier 44 and/or cover 48 are made. In such case the strain relief body 25 may be molded in such a way as to bond with such other part(s) of the cable termination assembly 10 further increasing the overall structural integrity thereof. Regardless, during molding of the strain relief body 25, the material tends to penetrate areas of the cover 48, contact carrier 44, and contacts 46 to assure a secure connection therewith after such molding material freezes or solidifies.

Furthermore, if the cable is not of the coaxial type, it would be possible to form in the cable insulation a plurality of slits, e.g. using laser scoring. Such slits may be located in position to have material of which the strain relief body 25 is molded flow therein, preferably therethrough, to effect a strain relief locking function securing the cable in the strain relief body, as is disclosed, for example, in the above-mentioned patent application.

During use of the cable termination assembly 2, the cable termination 2 may be plugged onto a header, a male connector, or other electrical connection device to effect connections of plural conductors of the cable 3 with respect to further circuits. The strain relief boot 1 being secured to the strain relief body 25 of the cable termination 2 and being mounted with respect to the cable 3 prevents sharp flexing or bending of the cable.

Figure 23:
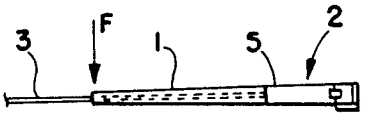
FIGS. 23 and 24 are illustrations of a cable termination assembly with a strain relief according to the invention showing the application of force and the results of such application, respectively.
Figure 24:
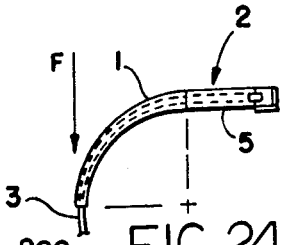
Figure 26:
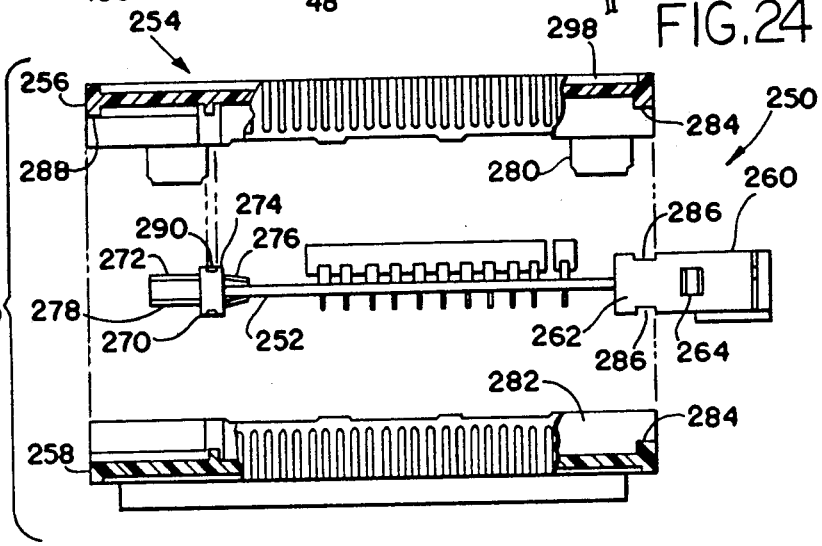
FIG. 26 is an exploded end elevation view of a printed circuit board termination assembly and housing structure according to the invention.
Figure 29:
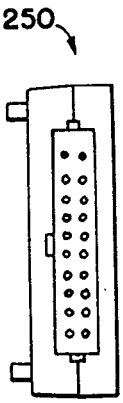
FIGS. 27–29 are, respectively, top, front end and back end views of the assembled printed circuit board termination assembly and housing structure according to the invention.
Figure 27:
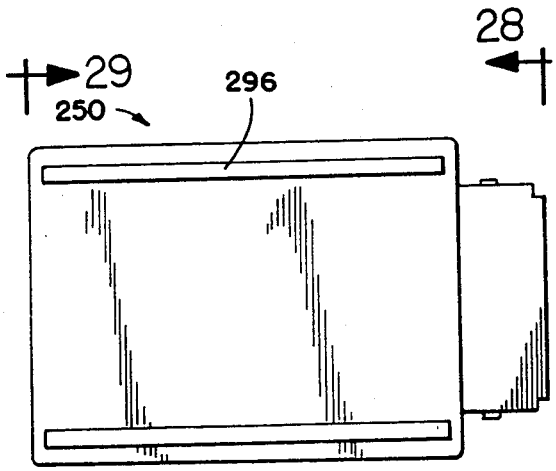

Briefly referring to FIGS. 23 and 24, the application of force F to the back end of the strain relief 1 or to the cable 3 thereat effects bending of the strain relief 1 and the cable while the cable termination 5 remains fixedly positioned, e.g. connected in a socket or the like, not shown. The exemplary strain relief 1 of FIGS. 23 and 24 may be formed of flexible polyester, have a height proximate the front end 17 of about 0.25 inch (the same as the strain relief body 25), a height proximate the back end 18 of about 0.10 inch (slightly greater than that of the cable 3), a length of about 2.5 inches, and a linear taper from front to back, as is illustrated and described herein. The gradual curvature of the cable and strain relief 1 is seen quite clearly in FIG. 24 as a result of such force F, for example of about one pound; it is the controlled bending characteristic of such tapered beams 15, 16 that force the curing to be relatively gradual and uniform at a constant radius of curvature over a ninety degree bend. Desirably the taper characteristics of the beams 15, 16 and the resiliency characteristics thereof are such that during such bending the curvature of the curved cable and strain relief 1 remains generally tangent to the cable termination 5, as in seen in FIG. 24 and the cable 3 is generally tangent to such curved strain relief at the back end 18. Accordingly, such taper provides a controlled radius of bending, uniform curvature, and uniform stress distribution in the cable. It will be appreciated that for other forces F, for other bending characteristics of the cable, etc. other configurations of strain relief 1 may be employed generally using the tapered beam(s), and holding and securing mechanisms described generally herein.

Indeed, it has been found that the use of the strain relief boot 1 in conjunction with a cable termination assembly as has been described hererin has appreciably increased the number of times the cable 3 can be bent or flexed relative to the strain relief body 25 and cable termination 5 without damaging the cable or the conductors therein compared to the number of times such a bending or flexing could occur without damage when no such strain relief boot 1 is employed. Especially when the cable 3 is of the coaxial type, the controlled bending and avoidance of sharp bends are important to prevent damage not only to the conductors of the cable but also to prevent damage to the insulation between them in order to preserve the impedance characteristics of the cable. Such cable 3 may have an outer jacket of PVC or other material and the insulation between the ground and signal conductors may be Teflon or similar material; such Teflon is relatively soft and the ability to prevent damage thereto due to flexing is advantageous.

A particular advantage to the use of the members 30 without directly molding or attaching the same to the cable 3 is that they can slide relative to the cable and can spread force application to the cable. Therefore, during bending described above, minimum force concentration occurs at each given area of the cable, and such minimization helps to avoid damage both to the conductors of the cable and the insulation both internally (if coaxial cable) and externally. On the other hand, it is possible that the strain relief boot 1 can be molded directly to the cable 3, particularly if the cable is not of the coaxial type. If the cable is of the coaxial type, the cable may tend to distort during such direct molding; whereas, if the cable were of the flat ribbon type that does not include internal insulation separating ground and signal conductors, the direct molding of the strain relief boot to the cable, e.g. as part of the formation of the strain relief body 25 is possible.

An advantage to the secure connection of the strain relief boot 1 to the strain relief body 25 and cable termination 5 is that application of force to the boot 1 tending to pull the cable termination assembly 2 from connection with an external member, socket, header, etc., not shown, will not put strain on the junctions of the conductors 54, 55 and the contacts 46. Flutes 200 on the edges of the strain relief body 25 also facilitates manually grasping the same to install or to remove the cable termination 5 with respect to an external member having pin contacts, etc. to which the respective contacts 46 may be connected. A key 202 in the form of a protruding ledge on the body of the housing cover 48 may be provided to assure that the cable termination 5 is inserted or connected with respect to another connector in correct alignment and/or polarization direction;

for example, such alignment may be provided by the fit of the key 202 into a mating recess in such other connector. Protrusions 204 on the sides of the cable termination 5 may be used to lock the same in a socket or other device into which it is inserted.

Figure 25:
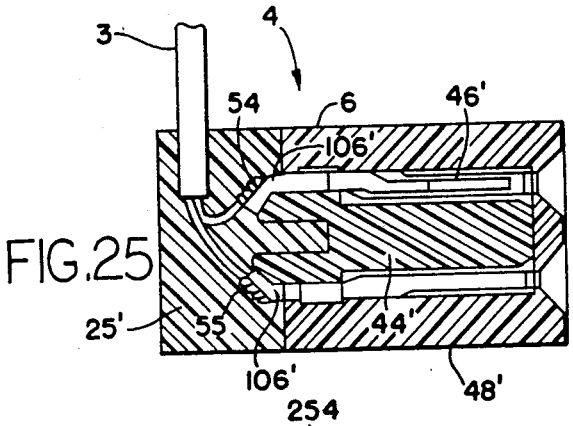
FIG. 25 is an end elevation view of a low profile cable termination assembly according to the invention.

Turning, now, briefly to FIG. 25, a low profile cable termination assembly 4, which is formed by a combination of the cable 3 and the low profile cable termination 6, is illustrated. The cable termination assembly 4 is similar to the cable termination assembly 2 described above, and primed reference numerals in FIG. 25 designate parts similar to those designated by corresponding unprimed reference numerals in the cable termination assembly 2. However, in the cable termination assembly 4 the cable 3 exits the molded strain relief body 25' generally at an angle, such as 90 degrees, relative to the generally linear extent of the contacts 46'. Desirably the molded strain relief body 25' is formed of elastomeric material that is directly injection molded to the preassembled housing, carrier and contacts of the termination assembly 4, generally as was described above with reference to the assembly 2.

The contacts 46' (as in FIG. 13, only one contact 46' is shown in entirety in FIG. 25, the other being partly omitted in the drawing for clarity) have truncated connecting ends 106' that do not extend far beyond the back end of the carrier 44'. The signal and ground conductors 54, 55, however, are exposed beyond the cable insulation, are placed over the connecting ends 106' of the contacts and are soldered thereto. As was described above, the ground conductors are connected to the contacts 46' in one row thereof, and the signal conductors are connected to the contacts 46' in the other row. The carrier 44' and the cover or housing 48' are substantially the same as the carrier 44 and cover 48 described above, and the contacts 46' are otherwise the same as the contacts 46 described above.

After the subassembly of the carrier 44', contacts 46' and housing 48' are assembled and the conductors 54, 55 are soldered or are otherwise attached to the contacts 46', and the strain relief body 25' is molded in place. Due to the truncating of the contacts so that the connecting ends 106' thereof do not extend beyond or much beyond the carrier 44', the size (height extending back from the cover 48') of the strain relief body 25' can be rather smaller than that of the the strain relief body 25'. Therefore, the cable termination assembly 4 effectively has a lower profile than that of the cable termination assembly 2. The molded strain relief body 25' secures the varoius portions, such as the contacts, carrier and housing, of the cable termination assembly 4 in place as a substantially integral structure. If desired, the cable termination assembly may include the various features of the cable termination assemblies disclosed in the above-mentioned copending U.S. patent application.

Referring to FIGS. 26–29, a printed circuit board termination assembly 250 is shown. The assembly 250 may be used, for example, to contain a printed circuit board 252 on which one or more integrated circuits, discrete components (such as resistors, capacitors, inductors, transistors, etc., or the like may be mounted and also containing printed circuit traces to form respective circuits thereon; and the assembly 250 provides for connecting of a cable termination assembly or the like directly to the circuitry on the printed circuit board via one or more electrical connectors to be described further below. The assembly 250 includes a housing 254 formed by a pair of cover parts 256, 258 that may be assembled together to contain therein the printed circuit board 252 and also to support the mentioned connectors with suitable access thereto.

One connector 260 is in the form of a termination generally similar to the cable termination 5 described above. However, briefly referring back to FIGS. 12 and 13, for example, instead of the cable 3 and conductors 54, 55 thereof being connected to the respective contacts 46, in the termination 260 the printed circuit board is slid between the connecting portions of the two parallel rows of contacts for the printed circuit traces on the board to make electrical connection and physical engagement with such connecting portions. Such connections may be secured further by soldering, either as a separate application of solder or by reflowing solder already contained on the connecting ends of the contacts 46. If desired, the leading edge of the printed circuit board coupled to the termination may be inserted into the slot 90 in the carrier 44, e.g. as the ground bus, etc., are slipped into the slot in the carrier as is disclosed in the above-mentioned copending U.S. Patent Application.

After the aforesaid assembling of the printed circuit board and termination 260, as aforesaid, a strain relief body 262 may be molded in place directly to at least part of the termination housing, carrier, contacts and at least part of the printed circuit board to form a secure integral structure. The strain relief body may include a pair of protrusions 264 on opposite sides thereof to snap fit into recesses in a connector system to which the termination 260 may be connected. The various other features of the termination 260 are as in the termination 5 described in greater detail above.

The other connector 270 mounted on the printed circuit board 252 at the opposite end from the connector 260 is in the form of a male header. Such male header has a plurality of pin contacts 272 supported generally in parallel relation by a strain relief header body 274 molded directly to the pin contacts. The connecting ends 276 of such pin contacts are attachable directly to respective traces on the printed circuit board 252. To facilitate such connections, though, the pin contacts in respective parallel rows of the dual row header 270 are bent toward each other so they will engage such traces—the printed circut board having a thickness that is smaller than the usual spacing of the parallel rows of such contacts. Such bent contacts 276 preferably are soldered to the respective traces on the board 252. The contacts 272 also have contacting ends 278 which are aligned generally in a pair of parallel rows with the contacts themselves extending from the header body in parallel, spaced apart relation. The contacting ends 278 of the header pin contacts 272 are intended to be connect electrically to the contacts 46, for example, of the cable termaination assembly 40 described above or to another electrical connector.

Figure 28:
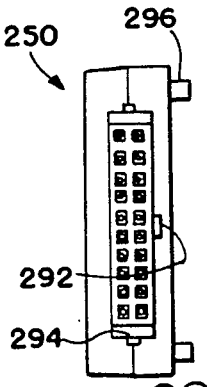

The housing 254 parts 256, 258 are mating parts; one has feet 280 that engage securely in openings 282 in the other to secure the housing parts together with the printed circuit board 252 and at least part of the connectors 260, 270 therein. Such housing parts 256, 258 may be ultrasonically welded together. Moreover, the housing has a pair of bar-like ledges 284 proximate one end to fit within recesses or slots 286 formed in the strain relief body of the termination 260 thereby securely to retain the latter in the housing when the parts 256, 258 thereof are secured together, as is seen in FIG. 28, for example. If desired, a similar retention mechanism may be provided for the connector 270, as is seen by the bar-like ledges 288 at the opposite end of the housing parts and a recess 290 in at least one surface of the header body 274.

From the foregoing, then, it will be appreciated that the housing 254 contains the printed circuit board 252 and at least part of the connectors associated therewith; and means are provided generally to secure one or both of the connectors with respect to the housing parts. The printed circuit board termination assembly 250, including the connector termination 260 and the printed circuit board are particularly secure as an integral structure due to the direct molding of the strain relief body 262. Thus, the assembly 250 is a relatively strong one, generally assuring stronger and more secure connections between the printed circuit traces on the board 252 and the contacts within the termination 260. The termination 260 may receive a male connector having pin contacts plugged into the openings of such termination to engage the fork or other contacts therein; and the header 270 may connect with the cable termination assembly 40 described above. Regarding the latter, the housing 254 has a key slot 292 to receive the polarizing-/alignment key of the cable termination assembly 40 and also may include plural recesses 294 to receive the locking protrusions 264 on the edges of the cable termination 5 strain relief body 25.

Also, regarding the housing 254, feet 296 along the bottom and slot-like recesses 298 along the top permit a plurality of such housing or like devices to be stacked relative to each other. Such feet may fit relatively securely in such recesses to hold such housing, for example, together.

STATEMENT OF INDUSTRIAL APPLICATION

With the foregoing in mind, then, it will be appreciated that the present invention provides for the electrical interconnection of multiple circuits in an effective efficient manner and prevents damage to cables due stress caused by flexing thereof.

We claim:

1. A strain relief for a cable termination assembly that includes a flat cable and a cable termination, comprising tapered beam means for undergoing controlled bending according to a prescribed function, securing means at one end of said tapered beam means for securing said tapered beam means to the cable termination, and holding means for holding said tapered beam means with respect to the cable to control the bending of the cable, said holding means including means defining a passageway for sliding receipt of the cable, and said tapered beam means including a pair of laterally spaced-apart, tapered beams of rail-like configuration extending generally parallel to said passageway at respective opposite edges of said passageway.

2. The strain relief of claim 1, wherein said holding means includes a plurality of holding members extending laterally between and connected to said tapered beams, and at least two of said holding members being located on one side of said passageway in spaced-apart relationship and at least one other of said holding members being located on an opposite side of said passageway.

3. The strain relief of claim 2, wherein respective pluralities of said holding members are arranged in two rows defining therebetween said passageway.

4. The strain relief of claim 3, wherein said holding members are of slat-like configuration, and said holding members in each row have major planar extents generally coplanar with one another.

5. The strain relief of claim 3, wherein said holding members in one row are alternately staggered with holding members in the other row along the length of said passageway.

6. The strain relief of claim 1, wherein said tapered beams have substantially flat and parallel inside surface means for engaging respective edges of the flat cable laterally to retain the cable in said passageway.

7. The strain relief of claim 1, wherein said tapered beams each are of substantially uniform width and taper in height from said one end of said tapered beam means to an opposite end of said tapered beam means.

8. The strain relief of claim 1, wherein said tapered beams each taper from a relatively large cross-section at said one end of said tapered beam means to a relatively small cross-section at an opposite end of said tapered beam means.

9. The strain relief of claim 8, wherein said tapered beam means taper uniformly from said relatively large cross-section to said relatively small cross-section.

10. A cable termination assembly comprising the strain relief of claim 1, a flat cable extending through said passageway of said strain relief, and a cable termination joined with said securing means of said strain relief.

11. The assembly of claim 10, wherein said holding means slidingly engages said cable.

12. The assembly of claim 10, wherein said holding means includes a plurality of holding members extending laterally between and connected to said tapered beams, and at least two of said holding members being located on one side of said passageway and at least one other of said holding members being located on an opposite side of said passageway.

13. The assembly of claim 12, wherein respective pluralities of said holding members are arranged in two rows defining therebetween said passageway.

14. The assembly of claim 10, wherein said securing means includes a locking protrusion forming a groove, and said cable termination includes a molded body having a part thereof molded about said locking protrusion and in said groove to form a mechanical interference preventing separation of said strain relief from said molded body.

15. A strain relief for a flat cable, comprising tapered beam means for undergoing controlled bending according to a prescribed function, and holding means for holding said tapered beam means with respect to the cable to control the bending of the cable, said tapered beam means including a pair of laterally spaced-apart tapered beams, and said holding means including plural slat-like members extending laterally between said tapered beams and arranged in two rows defining therebetween a longitudinally extending passageway for the cable which affords relative movement between the slat-like members and the cable.

16. The strain relief of claim 15, wherein said slat-like members in each row have mahor planar extents generally coplanar with one another.

17. The strain relief of claim 15, wherein said slat-like members in one row are alternately staggered with the slat-like member in the other row along the length of said passageway.

18. The strain relief of claim 15, in combination with the cable, said slatlike members having inner surfaces for slidingly engaging said cable.

19. The assembly of claim 18, wherein said tapered beams each has a raillike configuration.

20. A strain relief for a flat cable, comprising tapered beam means for undergoind controlled bending according to a prescribed function, and holding means for holding said tapered beams means with respect to the cable to control the bending of the cable, said tapered beam means including a pair of laterally spaced-apart tapered beams, and said holding means including plural holding members extending laterally between said tapered beams and arranged in two rows defining therebetween a longitudinally extending passageway for the cable which affords relative movement between the holding members and the cable, and said holding members in one row being alternately staggered with the holding members in the other row along the length of said passageway.

* * * * *

UNITED STATES PATENT AND TRADEMARK OFFICE

CERTIFICATE OF CORRECTION

PATENT NO. : 4,718,860

DATED : January 12, 1988

INVENTOR(S) : Roy A. Gobets and John N. Tengler

It is certified that error appears in the above-identified patent and that said Letters Patent is hereby corrected as shown below:

Column 1, line 8, correct the spelling of "assembly".

Column 5, line 43, "includes" should be —include—.

Column 5, line 46, correct the spelling of "electrically".

Column 6, line 28, correct the spelling of "characteristics".

Column 8, line 14, add the word "is" after —18—.

Column 8, line 64, should read —ductors 55—.

Column 9, line 6, change "was" to —way—.

Column 10, line 51, delete "panel" and insert —plane—.

Column 10, line 66, change "fron" to —from—.

Column 12, line 29, change "finter-like" to —finger-like—.

Column 12, line 39, change "tablike" to —tab-like—.

Column 14, line 52, add a comma after "25".

Column 16, line 55, correct the spelling of "termination".

Column 17, line 32, change "housing" to —housings—.

Column 18, line 60, correct the spelling of "major".

Column 18, line 64, change "member" to —members—.

Column 18, line 67, change "slatlike" to —slat-like—.

Column 19, line 2, change "raillike" to —rail-like—.

Column 19, line 4, correct the spelling of "undergoing".

UNITED STATES PATENT AND TRADEMARK OFFICE

CERTIFICATE OF CORRECTION

PATENT NO. : 4.718,860

DATED : January 12, 1988

INVENTOR(S) : Roy A. Gobets and John N. Tengler

It is certified that error appears in the above-identified patent and that said Letters Patent is hereby corrected as shown below:

Column 19, line 6, change "beams" to --beam--.

Signed and Sealed this

Nineteenth Day of March, 1991

*Attest:*

HARRY F. MANBECK, JR.

*Attesting Officer*

*Commissioner of Patents and Trademarks*